United States Patent [19]

Petty

[11] Patent Number: 4,930,629

[45] Date of Patent: Jun. 5, 1990

[54] CARRIER CARTON WITH SELECTIVELY POSITIONABLE SEPARATORS

[75] Inventor: James C. Petty, Mishawaka, Ind.

[73] Assignee: Indiana Carton Corp., Bremen, Ind.

[21] Appl. No.: 423,027

[22] Filed: Oct. 18, 1989

[51] Int. Cl.[5] ..... B65D 75/00

[52] U.S. Cl. ..... 206/185; 206/191; 229/120.09

[58] Field of Search ..... 206/170–191, 206/427; 229/117.14, 120.06, 120.09

[56] References Cited

U.S. PATENT DOCUMENTS

| | | | |
|---|---|---|---|
| 2,850,205 | 9/1958 | Painter | 206/185 |
| 3,203,585 | 8/1965 | Wood | 206/188 |
| 3,306,485 | 2/1967 | Wood | 206/191 |
| 3,446,414 | 5/1969 | Omori | 206/180 |
| 3,465,913 | 9/1969 | Zorn et al. | 206/172 |
| 4,509,640 | 4/1985 | Joyce | 229/117.14 |
| 4,601,390 | 7/1986 | Rosenthal et al. | 206/175 |
| 4,838,414 | 6/1989 | Blackman | 206/175 |

*Primary Examiner*—Jimmy G. Foster
*Attorney, Agent, or Firm*—James D. Hall

[57] ABSTRACT

A carrier carton having a flattened, collapsed form and an expanded box-like form defined by side panels and adjoining end panels with a bottom. A center panel extends between the end panels and a separator extends between the center panel and at least one of the side panels. A portion or extension of the separator is detachably connected to the one side panel so as to enable the separator to be a detached from the side panel at its extension and folded against the center panel.

5 Claims, 3 Drawing Sheets

CARRIER CARTON WITH SELECTIVELY POSITIONABLE SEPARATORS

SUMMARY OF THE INVENTION

This invention relates to a carrier carton and will have application to a carton which in its expanded form includes selectively positionable separators.

Heretofore carrier cartons, such as 4-cup carriers, have been formed with multiple separators dividing the carton into multiple sections to accommodate several products. Cartons of this nature are normally constructed from cardboard, have a flattened collapsed form for purposes of shipping and storage, and an expanded box-like form when readied for use. In the following described invention, the carton is provided when in its box-like form with separators having detachable extensions. Such detachable extensions of the separators allows the carton when first expanded to provide multiple sections or compartments for usage. When desired, such as when a larger product is to be carried within the carton, the separator extensions are detached from the remainder of the carton to allow the separators to be recessed or folded and thereby create an enlarged section or compartment within the carton. This versatility of design allows the carton to accommodate various shaped products without having to provide multiple sized cartons to accommodate various sized products.

Accordingly, it is an object of this invention to provide a carrier carton having product receiving compartments which can be varied in size.

Another object of this invention is to provide a carrier carton having separators which serve to form individual compartments within the carton and which may be repositioned within the carton to increase the size of the compartments.

Another object of this invention is to provide a carrier carton which is of economical construction and which allows a versatile use of the carton by varying the size of the product compartments of the carton.

Other objects of this invention will be come apparent upon a reading of the following description.

BRIEF DESCRIPTION OF THE DRAWINGS

A preferred embodiment of this invention has been chosen for purposes of description wherein.

DESCRIPTION OF THE PREFERRED EMBODIMENT

The preferred embodiment illustrated is not intended to be exhaustive or to limit the invention to the precise form disclosed. It is chosen and described in order to best explain the invention and to enable others skilled in the art to best utilize the invention.

Figure 3:
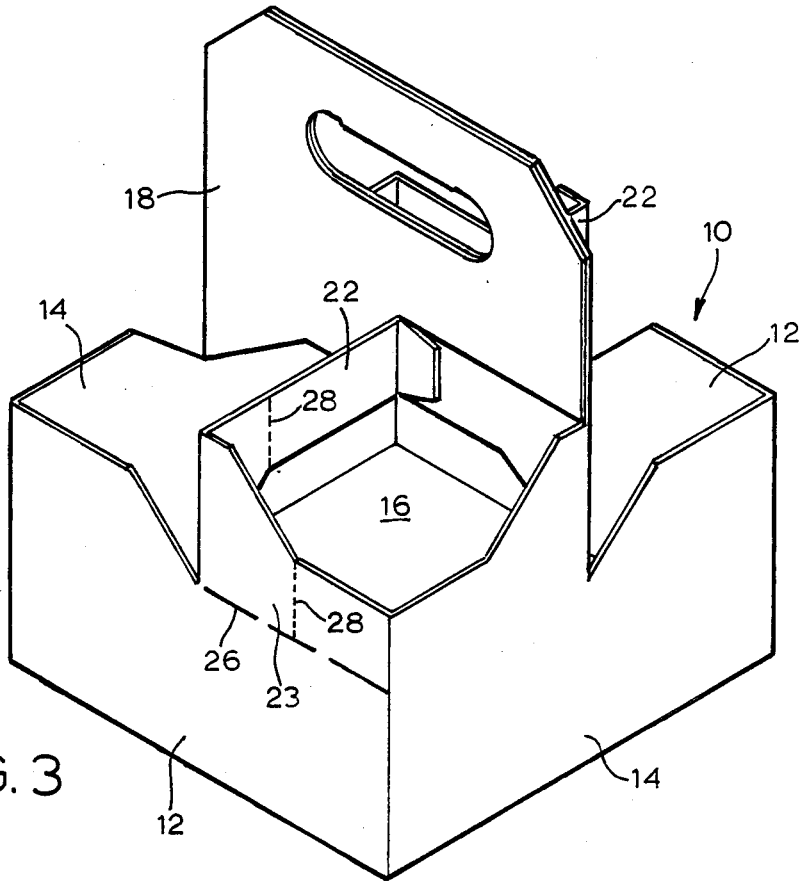
FIG. 3 is a perspective view of the carrier carton shown in its expanded box-like form with its two carton separators shown in their extended positions.
Figure 5:
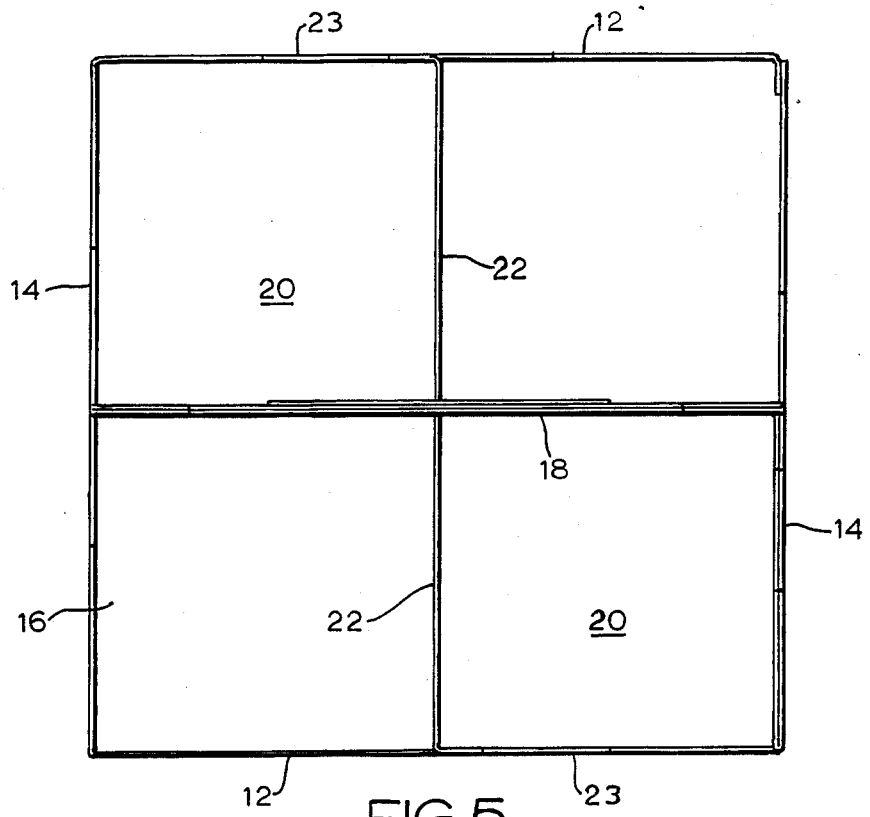
FIG. 5 is a top plan view of the carrier carton of FIG. 3.

Carton 10 of this invention is shown in its expanded, box-like form in FIG. 3 and includes parallel side panels 12, adjoining parallel end panels 14, a bottom 16, and a center panel 18. Center panel 18 extends between end panels 14 and serves to separate the interior of the carton into two compartments 20 in which each such compartment extends between the center panel and to a side panel 14 (compartments 20 are shown for illustrative purposes in FIGS. 5 and 6).

Figure 1:
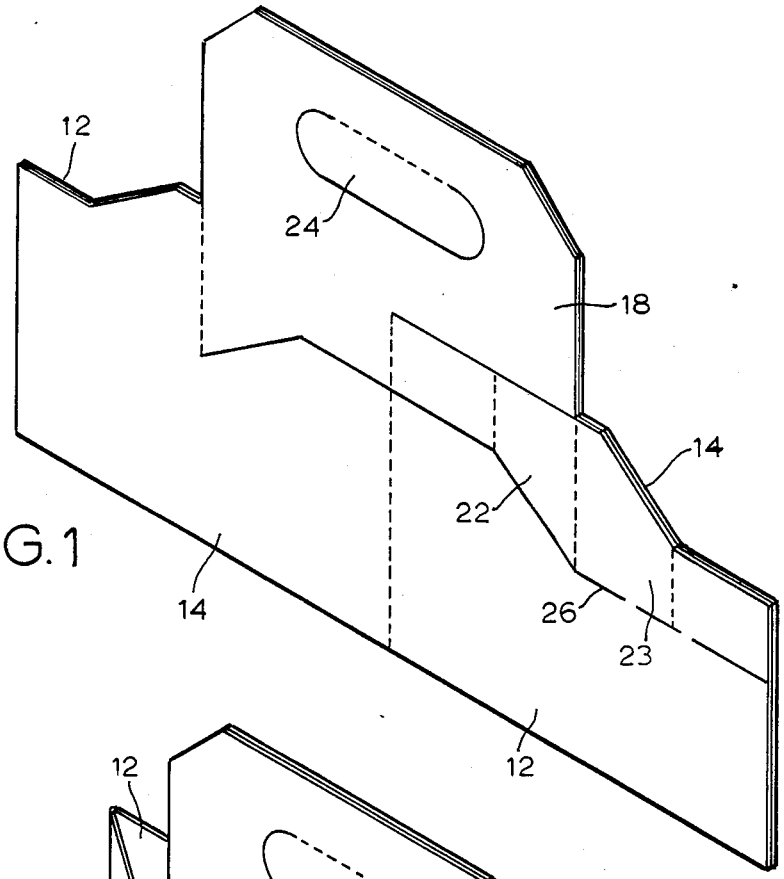
FIG. 1 is a perspective view of the carrier carton shown in its flattened collapsed form.
Figure 2:
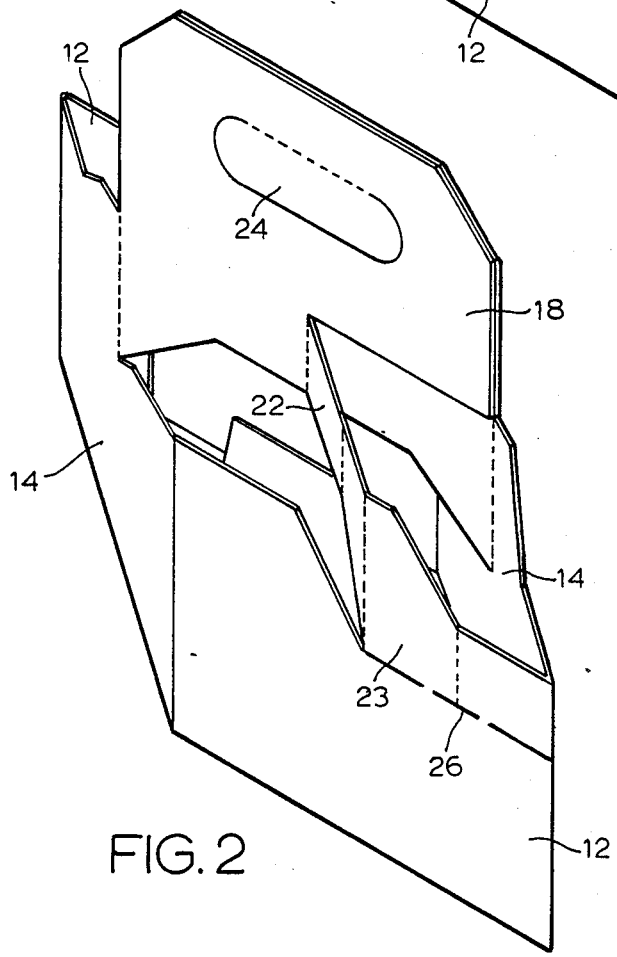
FIG. 2 is a perspective view of the carrier carton shown in an intermediate expanded form.
Figure 4:
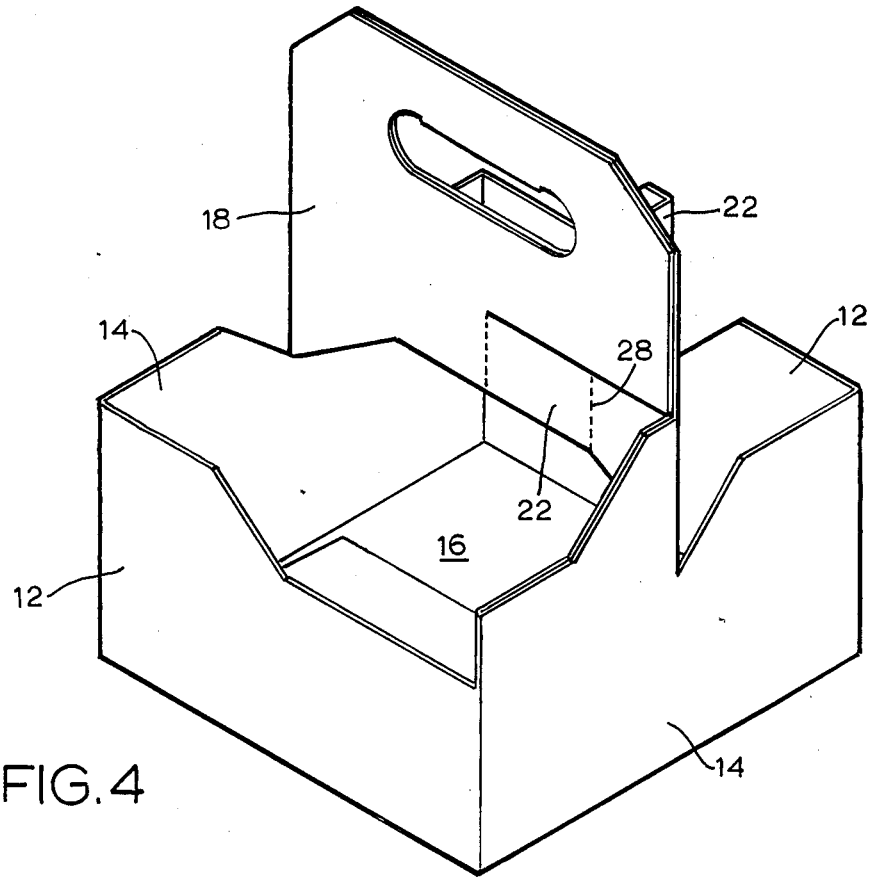
FIG. 4 is a perspective view of the carrier carton like FIG. 3 showing the carton in its expanded box-like form but with one separator shown in its recessed position.

Carton 10 as thus far described is of the usual and customary construction well known in the art. A carton blank is formed and appropriately joined at selected locations along glue laps with bottom 16 of the carton being formed by overlapping lower panels. Examples of such prior art cartons in patented form may be found in U.S. Pat. No. 4,509,640 and the references cited therein. Carton 10 of the subject invention is shown in its collapsed form in FIG. 1 and when opened into its expanded shape proceeds through the intermediate form as shown in FIG. 2 into the box-like form of FIG. 3. As is common in boxes of this design, a separator 22 extends from the center panel 18 to each of the side panels 12 to further divide each compartment 20 into separate sections so as to accommodate the products for which the carton is designed to carry. Again, carton 10 as so far described is of a common, well known construction and may be used to carry sandwich and drink items or food products. To facilitate usage of the carrier, a push out tab 24 is formed in center panel 18 which when opened, as shown in FIGS. 3 and 4, form in conjunction with the panel a handle.

Figure 6:
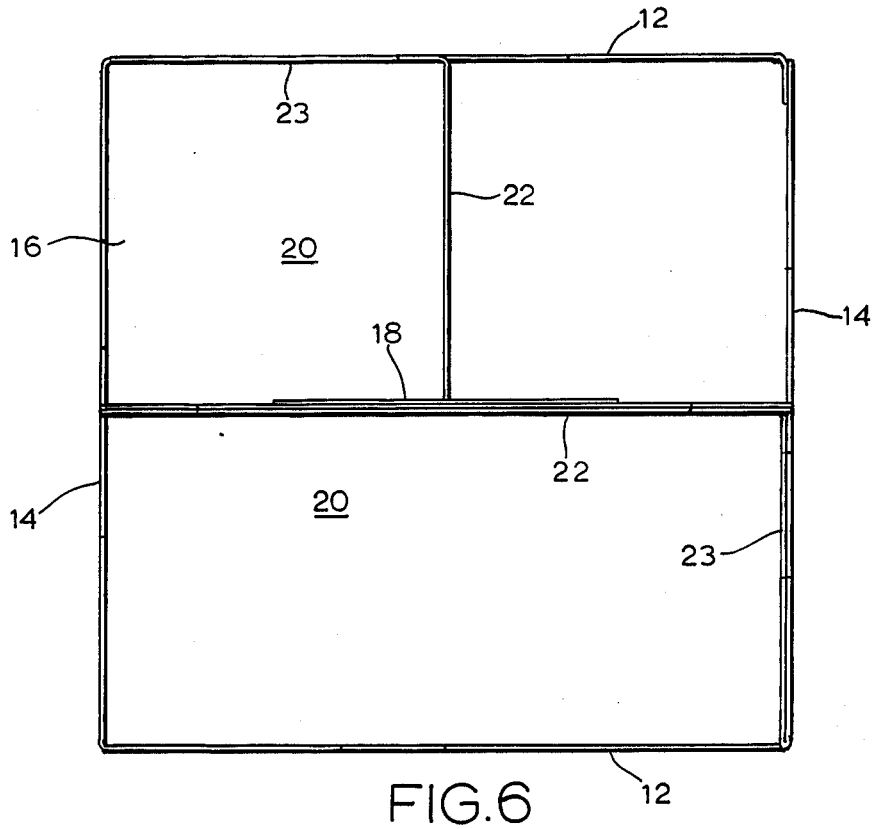
FIG. 6 is a top plan view of the carrier carton as seen in FIG. 4.

Each separator 22 includes an extension part 23 which is detachably connected along tear line 26 to the connecting side panel 12. In the illustrated embodiment, each separator extension 23 is coplanar with and forms a detachable part of the supporting side panel 12. When it is desired to convert carton 10 from the four-sectioned compartment illustrated in FIGS. 3 and 5 to either a three-sectioned compartment such as illustrated in FIGS. 4 and 6 or a two-sectioned compartment, a selected separator at its extension part 23 is detached along tear line 26 along the upper edge of the connecting side panel and the extension folded against the adjoining end panel 14 with the separator 22 being positioned against center panel 18 as illustrated in FIGS. 4 and 6. In this manner, carton 10 may be converted from a four part sectionalized container to either a two or three part sectionalized container to accommodate various products according to the wishes of the carton user. Score lines 28 are formed vertically across each separator 22 and its extension 23 to allow controlled bending, if necessary, of the separator and extension as the extension is disconnected from its attached side wall 12 and the separator and its extension are folded against center panel 18 and end panel 14 respectively.

It is to be understood that the invention is not to be limited to the details above given. Invention may be modified in accordance with the following claims.

What I claim is:

1. A carrier carton having a flattened collapsed form and an expanded box like form, said box-like form comprising parallel side panels and adjoining parallel end panels, a bottom, a center panel extending between said end panels to separate the interior of said box-like form into a compartment between the center panel each side panel, and a selectively positionable separator extending in a first position from said center panel to at least one of said side panels between said end panels to further divide such compartment formed between the center panel and one side panel into product carrying sections, said separator including an extension joined detachably to said one side panel, said separator having a second position extending adjacently along said center panel with its said extension detached from said one side panel and positioned adjacent one of said end panels to more fully expose said compartment between the center panel and said one side panel.

2. The carton of claim 1 wherein said separator in its said second position extends along said one side panel to said one end panel.

3. The carton of claim 2 wherein said separator extension is positioned along the upper edge of said one side panel.

4. The carton of claim 1 and a second selectively positioned separator extending in a first position from said center panel to the other of said side panels between said end panels position to further divide said compartment formed between the center panel and said other side panel into product carrying sections, said second separator including an extension joined detachably to said other side panel, said second separator having a second position extending adjacently along said center panel with its said extension detached from said other side panel and positioned adjacent one of said end panels to more fully expose that compartment between the center panel and said other side panel.

5. The carton of claim 4 wherein said center panel includes handle means for carrying said carton in its box-like form.

* * * * *